US005820050A

United States Patent [19]

Zollinger

[11] Patent Number: 5,820,050

[45] Date of Patent: Oct. 13, 1998

[54] ADJUSTABLE YARN TENSIONING DEVICE

[76] Inventor: Richard V. Zollinger, 10 Donald Rd., Spartanburg, S.C. 29307

[21] Appl. No.: 885,574

[22] Filed: Jun. 30, 1997

[51] Int. Cl.[6] ..... B65H 59/22; B65H 23/08

[52] U.S. Cl. ..... 242/152.1; 226/195

[58] Field of Search ..... 242/151, 152.1, 242/419.5; 226/195

[56] References Cited

U.S. PATENT DOCUMENTS

| | | | |
|---|---|---|---|
| Re. 31,024 | 9/1982 | Zollinger | 242/152.1 |
| Re. 31,041 | 9/1982 | Zollinger | 242/152.1 |
| 4,017,038 | 4/1977 | Paepke | 242/152.1 |
| 4,083,514 | 4/1978 | Levin | 242/152.1 |
| 4,095,757 | 6/1978 | Singer | 242/152.1 X |
| 4,406,424 | 9/1983 | McBride | 242/152.1 |
| 4,470,559 | 9/1984 | McBride, Jr. | 242/152.1 |
| 4,516,738 | 5/1985 | Nurk | 242/152.1 |
| 4,558,834 | 12/1985 | Plucknett | 242/152.1 |
| 4,568,038 | 2/1986 | Frentzel-Beyme | 242/152.1 |
| 4,807,829 | 2/1989 | Zollinger | 242/152.1 |

*Primary Examiner*—Michael Mansen
*Attorney, Agent, or Firm*—Kennedy Covington Lobdell & Hickman, LLP

[57] ABSTRACT

An adjustable yarn tensioning device for maintaining generally uniform tension in a running textile yarn that runs through a ball seat so that a ball on the seat applies a gravitational tensioning force to the running yarn. The ball seat is formed in a depending cup that is selectively rotated to align with any one of a plurality of chambers through which the yarn travels to a common outlet. The chambers contain different size or weight ball combinations so that alignments can be selected to provide a desired tension. In addition to a preferred embodiment in which the cup rotates under the chambers, the device may be formed for sliding of the cup longitudinally under a straight line arrangement of the chambers.

26 Claims, 7 Drawing Sheets

ADJUSTABLE YARN TENSIONING DEVICE

BACKGROUND OF THE INVENTION

The present invention relates to an adjustable yarn tensioning device for maintaining generally uniform tension in a running textile yarn and, more particularly, to an adjustable yarn tensioning device of the type utilizing spherical elements to maintain tension on a running textile yarn.

Yarn tensioning devices using spherical elements or balls have been highly successful in improving the quality of textile yarn and fabrics made of textile yarn and in improving productivity by maintaining uniform tension in the running yarn. Devices of this type are disclosed in U.S. Pat. Nos. RE. 30,920; RE. 31,024; and RE. 31,041, all issuing to Otto Zollinger. These devices have one or more balls supported on an annular seat with the balls retained in a housing that allows vertical movement, but limits horizontal movement of the balls so that the balls rest on and apply restraint to a running textile yarn that passes through the seat and housing, thereby applying relatively uniform tension to the running yarn and smoothing out fluctuations in tension that may be in the yarn upstream of the device. Modifications of such ball tensioning devices are disclosed in U.S. Pat. Nos. 4,807,829 and 4,824,043, both issued to Otto Zollinger, and U.S. Pat. Nos. 4,094,477; 4,279,388; 4,403,754; 4,406,424; and 4,470,559.

Ball tension devices of this type are readily adaptable to apply a wide range of selected tension to adapt the devices for use for particular purposes and for particular yarn types and sizes by changing the number and/or size of balls used in the devices. For example, with very light yarns, a single small ball can be used and for heavier yarns and applications where greater tension is desired, larger balls and multiple balls may be substituted.

To be capable of making changes, it is, therefore, necessary to have an inventory of balls and balls of different sizes, which inventory may be a problem to maintain. Also, early devices of this type were open at the top, which allowed easy changing of balls, but exposed the devices to attendant error and discretion resulting in non-uniform tension between yarns being fed to a textile machine through different devices. To prevent the escape of balls and the improper use of different balls in different tensioning devices on a textile machine, devices are now commonly provided with a cap secured in the top of the device that prevents removal or changing of the balls in the device. This assures that all devices on a particular textile machine can have the same ball size and/or number of balls, but this requires an inventory of ball tensioning devices to be able to change to differing conditions. This is a particular disadvantage to machine manufacturers who must carry a large inventory of yarn tensioning devices and adapt each machine with the selected yarn tensioning devices needed for the particular application of the customer.

The present invention overcomes the disadvantages of prior art ball tension devices by providing a ball tension device having a plurality of chambers containing different number and sizes of balls, with the device being adjustable to position a selected chamber for feeding of yarn therethrough. Thus, one ball tensioning device is adaptable to a range of uses, depending on the number of chambers, and a machine may be outfitted with only one device that is adjustable for different conditions without the need for an inventory of different devices and without the need for an inventory of loose balls. This is a particular advantage for a machine manufacturer who can attach one type of ball tension device to all machines and either adjust the devices before the machine is shipped to a customer or the customer can adjust the devices before using the machine and can readily adjust the devices to adapt to changes in machine operating conditions.

SUMMARY OF THE INVENTION

The adjustable yarn tensioning device of the present invention includes a housing having an upper body portion and a lower body portion connected for relative movement with one of the body portions having a plurality of chambers and the other body portion having a chamber that can be selectively positioned in alignment with one of the plurality of chambers. A closure surface on the other body portion covers the openings in the chambers that are not aligned. A plurality of at least partially spherical elements are disposed in the chambers with the characteristics of the elements differing in each selective chamber alignment. In each alignment, the lower body portion has an annular seat for supporting the spherical portion of one of the elements, with the annular seat forming a yarn passage and the chamber adjacent the seat being shaped to retain the spherical portion of the element in contact with a yarn running through the passage.

The differing characteristics of the elements in the different chambers is obtained by utilizing different number and/or size element combinations in the chambers.

Preferably, the plurality of chambers extend parallel to each other to a common communication with the exterior, with the parallel chambers being spaced equidistant about a central axis. An annular outlet cap is seated in the common communication, with the cap and common communication having complementary tapered inner surfaces.

Also preferably, the chambers are spaced equidistant about a central axis and are open toward the central axis to form a common central axial space in which a post extends along the central axis to retain the elements in their respective chambers, while providing the significant advantage of allowing adjustment to change the chamber alignment without having to remove the yarn, thereby avoiding having to rethread the device when a chamber alignment adjustment is made. The chambers are semi-cylindrical outwardly of the common central axial space, and the common communication is centered on the central axis, so that the yarn exits the device at the same axial location for all chamber alignments.

In the preferred embodiment, the upper body portion has a relatively flat lower end extending transverse to the central axis and an exterior cylindrical surface extending upwardly from the lower end, with the lower body portion having a flat surface opposite the lower end of the upper body portion and having a cylindrical sleeve extending upwardly along the cylindrical exterior surface of the upper body portion resulting in the body portions being relatively rotatable about the central axis. The body portions are maintained in rotatable engagement by an annular groove in either the cylindrical surface of the upper body portion or the cylindrical sleeve of the lower body portion, and an annular ridge in the other body portion engages in the groove to retain the portions in assembled rotatable relation.

The upper and lower body portions have complementary alignable formations disposed for alignment upon each chamber alignment, with a component engageable with the formations when there is a chamber alignment to maintain the alignment during use and disengageable to permit relative movement of the body portions for realignment. The formations are preferably apertures and the component is preferably a rod engageable in aligned apertures.

Rotation of the body parts is limited to less than a full revolution to avoid wrapping of the yarn around the central post, by complementary projections formed on the upper and lower body portions that are engageable during relative rotation.

To permit cleaning of lint and other matter from the chambers, the housing is preferably formed with slots extending from the exterior to the chambers to permit air to be blown into the slots. In the preferred embodiment, the slots extend through the lower body portion cylindrical sleeve and the upper body portion and extend substantially the full cylindrical extent of the chambers.

DESCRIPTION OF THE PREFERRED EMBODIMENT

Figure 1:
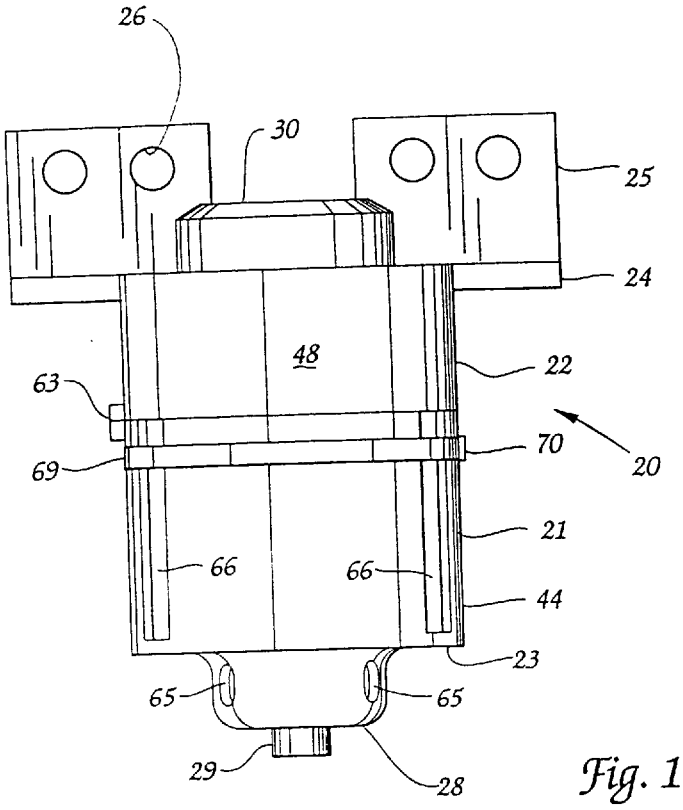
FIG. 1 is a front elevational view of an adjustable yarn tensioning device incorporating the preferred embodiment of the present invention.
Figure 2:
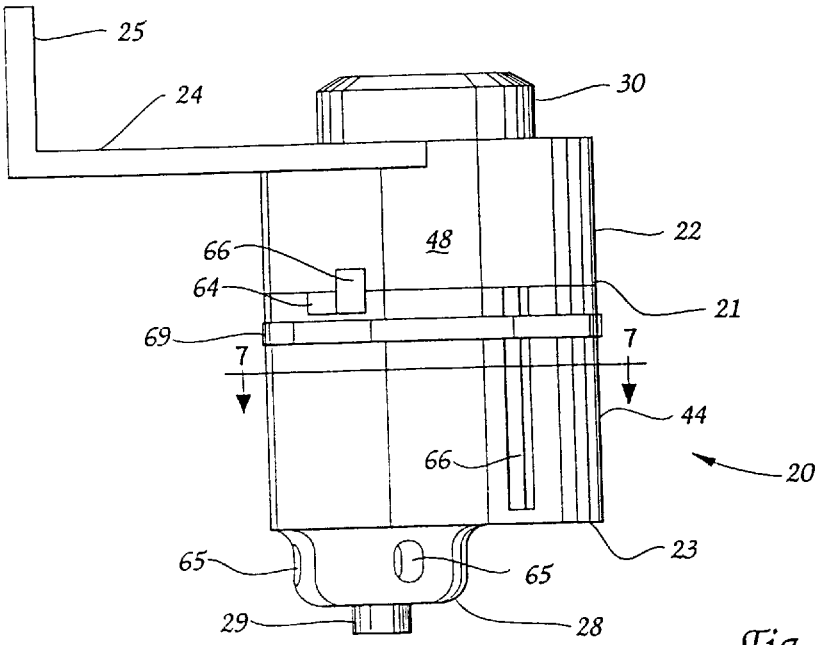
FIG. 2 is a side elevation of the yarn tensioning device of FIG. 1.
Figure 3:
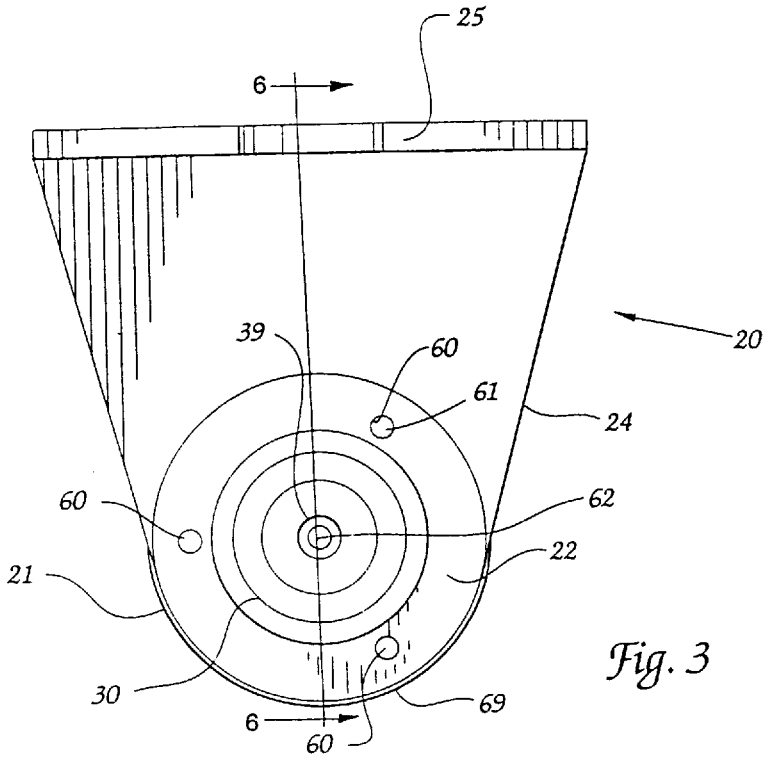
FIG. 3 is a plan view of the yarn tensioning device of FIG. 1.
Figure 4:
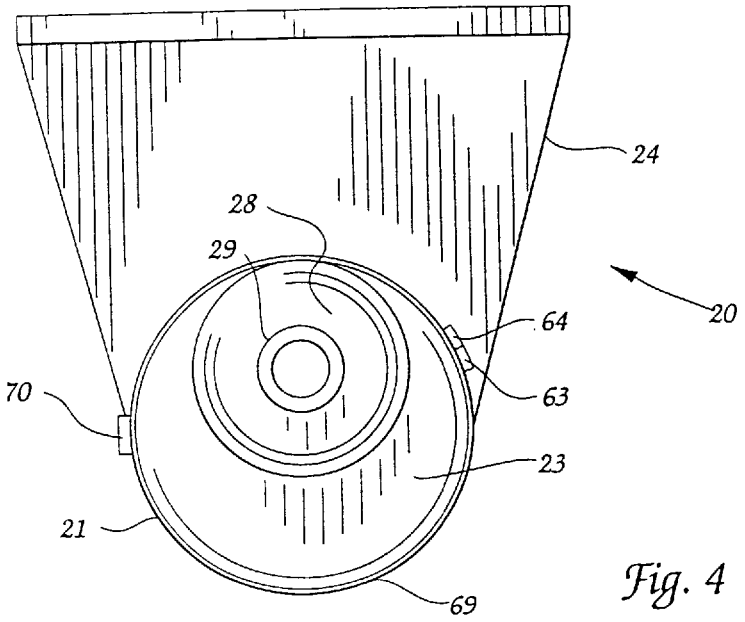
FIG. 4 is a bottom view of the yarn tensioning device of FIG. 1.
Figure 5:
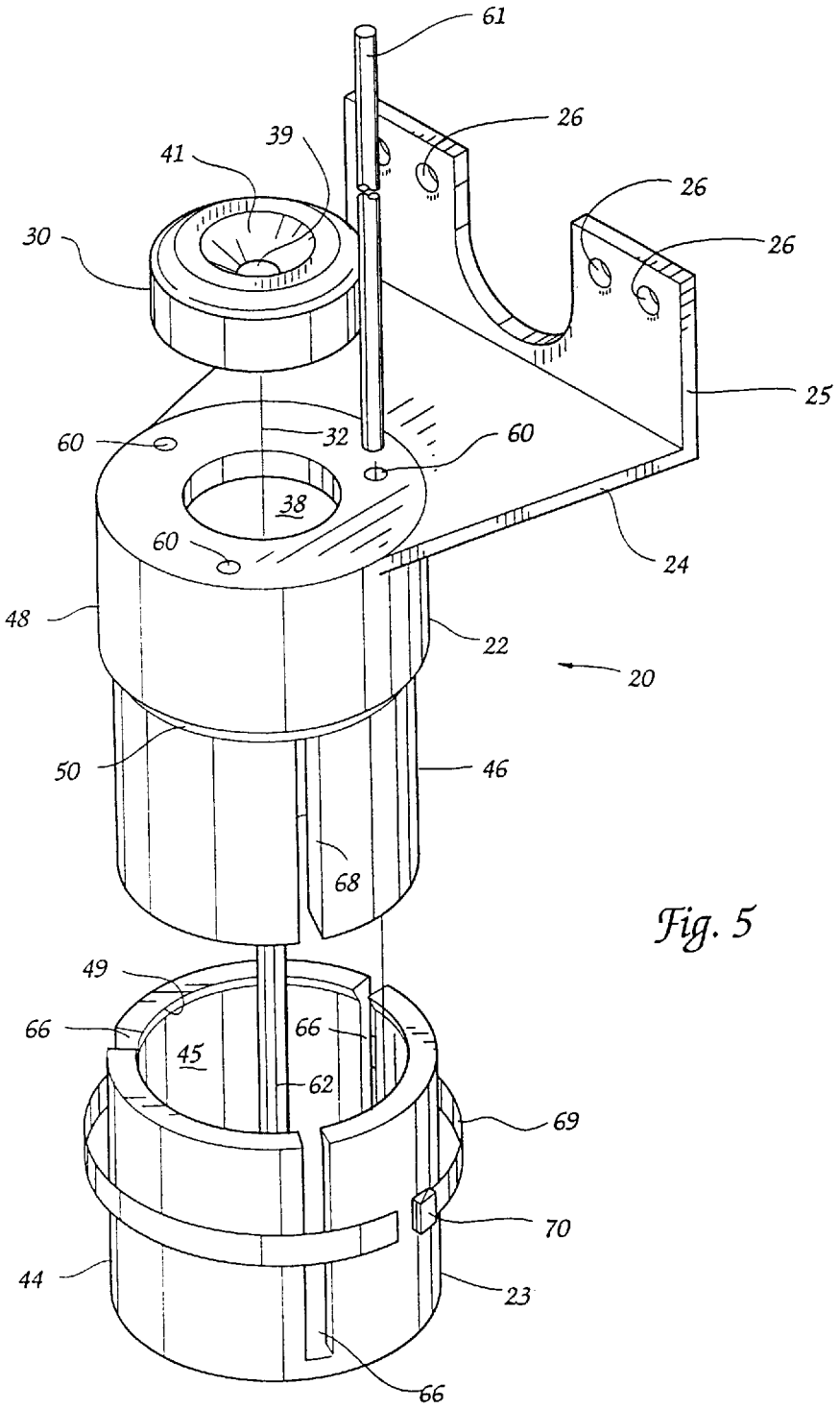
FIG. 5 is an exploded view of the yarn tensioning device of FIG. 1.
Figure 6:
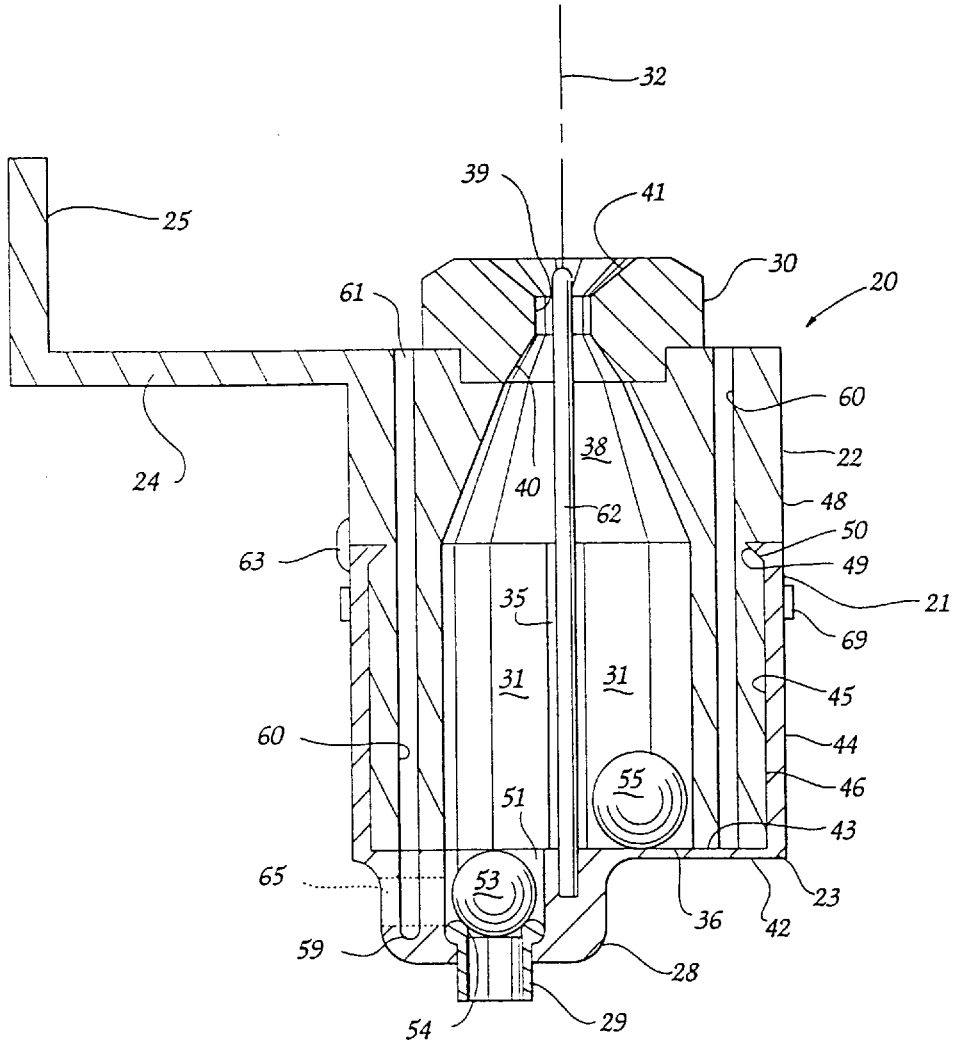
FIG. 6 is a vertical sectional view taken along line 6—6 of FIG. 3.
Figure 7:
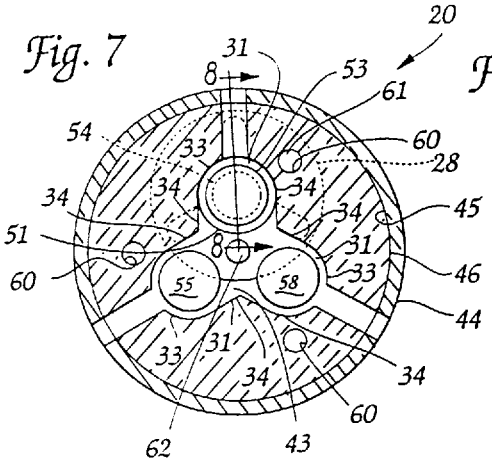
FIG. 7 is a horizontal sectional view taking along line 7—7 of FIG. 2.
Figure 8:
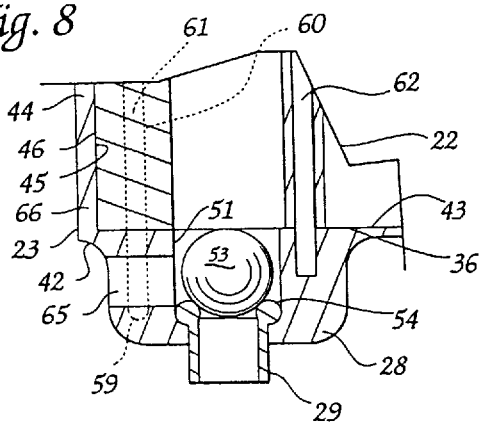
FIG. 8 is a partial vertical sectional view taken along line 8—8 of FIG. 7.
Figure 9:
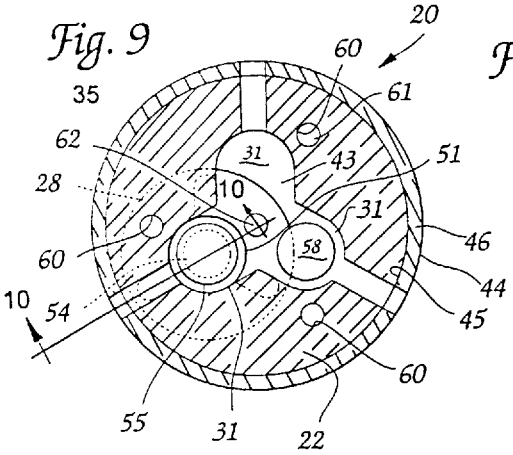
FIG. 9 is a view similar to FIG. 7 with the inlet cup shown in a second position.
Figure 10:
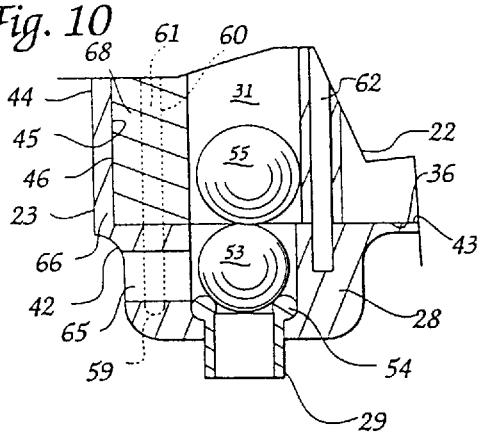
FIG. 10 is a partial vertical sectional view taken along line 10—10 of FIG. 9.
Figure 11:
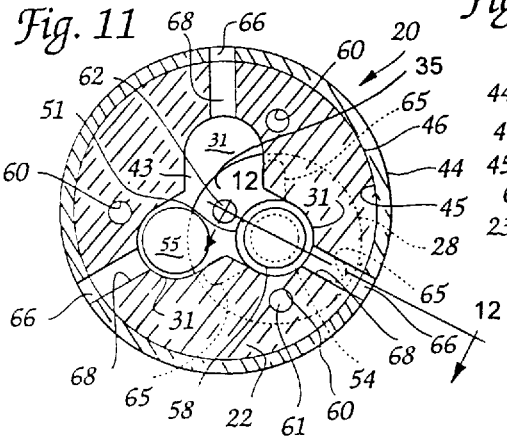
FIG. 11 is a view similar to FIG. 7 with the inlet cup shown in a third position.
Figure 12:
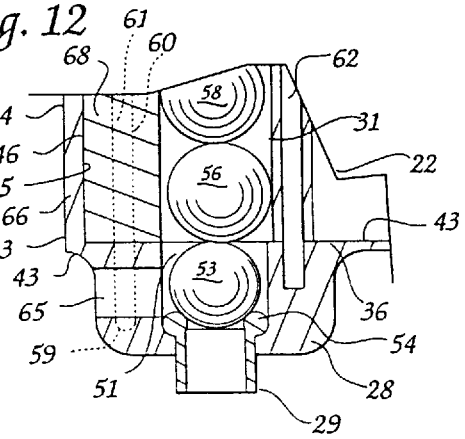
FIG. 12 is a partial vertical sectional view taken along line 12—12 of FIG. 11.
Figure 14:
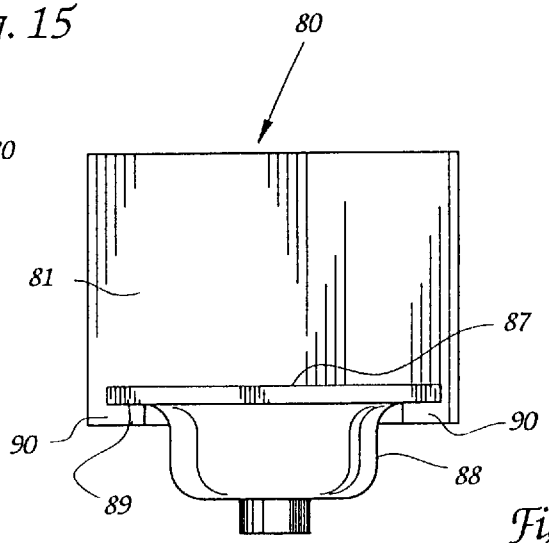
FIG. 14 is an end elevational view of the device of FIG. 13.
Figure 15:
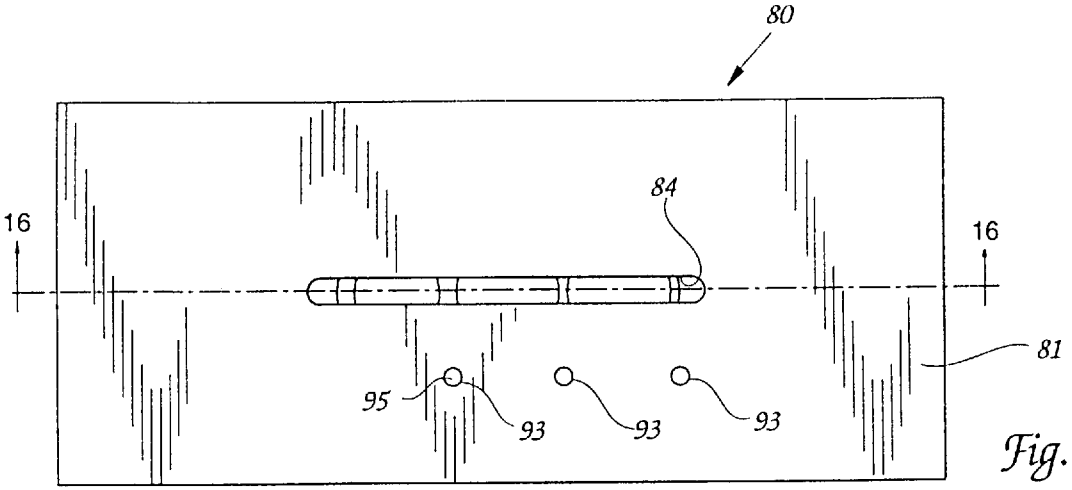
FIG. 15 is a top plan view of the device of FIG. 13.
Figure 13:
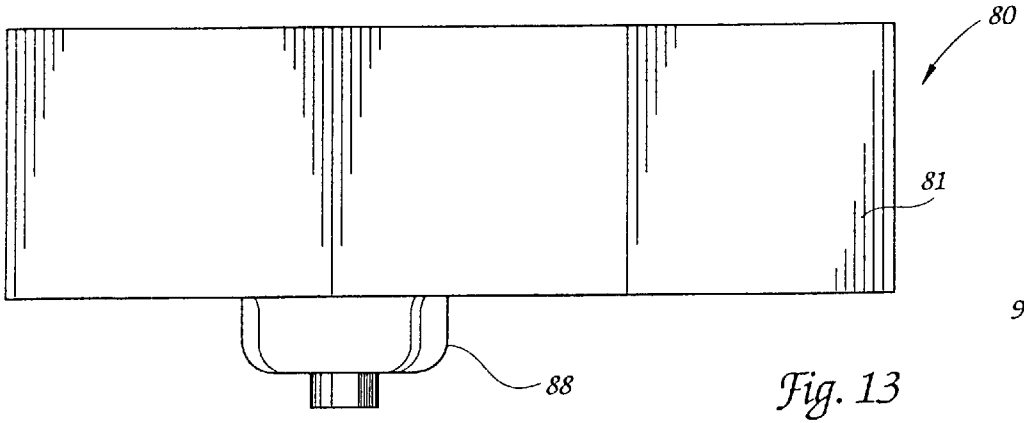
FIG. 13 is a side elevational view of an alternate embodiment of the yarn tensioning device of the present invention.
Figure 18:
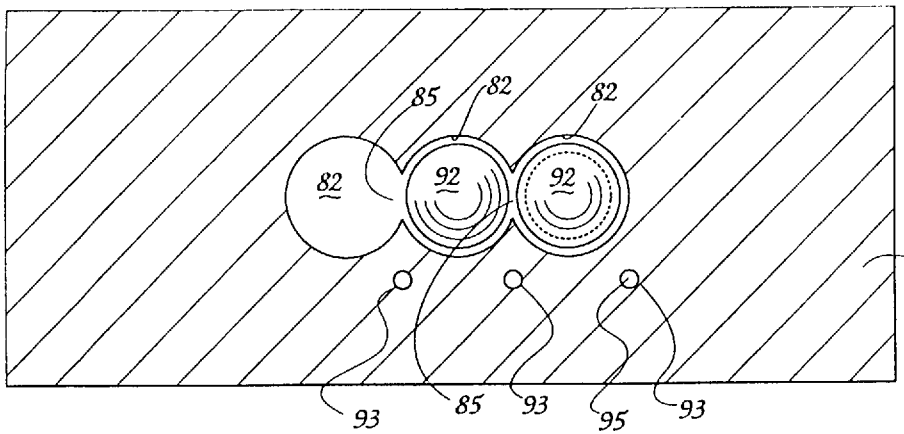
FIG. 18 is a horizontal cross-sectional view taken along line 18—18 of FIG. 16.
Figure 17:
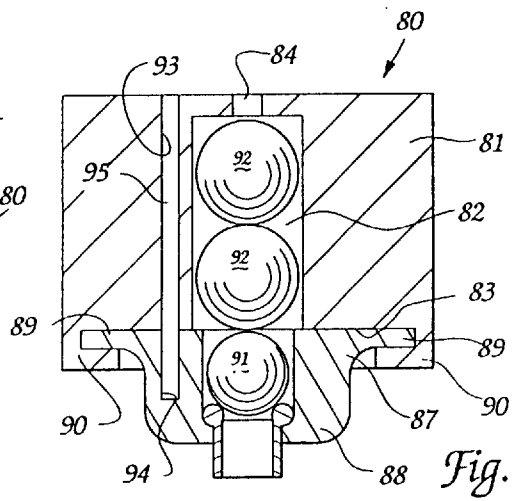
FIG. 17 is a vertical sectional view taken along line 17—17 of FIG. 16.

The preferred embodiment of the adjustable yarn tensioning device of the present invention is illustrated in FIGS. 1–12, in which the device 20 is seen to include a housing 21 formed with an upper body portion 22 and a lower body portion 23 secured together for relative rotation as described in detail below. An L-shaped bracket 24 is secured to the upper body portion 22 and projects horizontally therefrom to an upstanding flange 25 having holes 26 for mounting of the device 20 on a textile machine or adjacent creel in position for threading yarn through the device 20 for use in the machine. An inlet cup 28 is formed at the bottom of the lower body portion 23 and projects downwardly therefrom. An annular insert 29 is mounted in the cup 28 and extends downwardly therefrom for running of a yarn therethrough into the device 20. An annular outlet cap 30 is mounted in the upper body portion 22 and projects therefrom for running of the yarn from the body portions 22, 23 therethrough to the adjacent textile machine.

The upper body portion 22 is formed with a plurality of vertically extending parallel chambers 31, which are equally spaced about and from the central axis 32 of the device 20. In the illustrated embodiment, there are three such chambers 31. Each chamber is formed with a semi-cylindrical surface forming the outer periphery of the chamber 31 and extends inwardly tangentially to the semi-cylindrical surface 33 to form parallel straight inner surfaces 34 that intersect with similar straight inner surfaces 34 of adjacent chambers 31 for opening of the chambers 31 centrally into an open axial space 35. The chambers are open at the bottom surface 36 of the upper body portion 22, which bottom surface is flat and extends transversely with respect to the central axis 32. The chambers 31 extend upwardly from the bottom surface 36 parallel to each other and parallel to the central axis 32 into the upper section of the upper body portion 22 where they merge into a common communication 38 to the exterior through the central opening 39 in the outlet cap 30. The common communication 38 is formed by a frusto-conical shape of the common communication 38 surrounding the upper ends of the chambers 31 and tapering into a complementary tapered inner surface 40 of the outlet cap 30. To facilitate yarn travel without abrasion, the exterior surface 41 of the outlet cap 30 at the central opening 39 is similarly tapered.

The lower body portion 23 is formed with a circular base 42 having an inner flat surface 43 extending transverse to the central axis 32 in contact with the flat transverse bottom surface 36 of the upper body portion. The flat surface 43 of the lower body portion 23 forms a closure surface for the open bottoms of the chambers 31 except in the location of the inlet cup 28.

The lower body portion 23 is formed with an upstanding cylindrical sleeve 44 having a cylindrical inner surface 45 that fits over a corresponding lower outer cylindrical surface 46 extending downwardly on the upper body portion 22. With this connection, the lower body portion 23 can rotate about the upper body portion 22 to position the inlet cup 28 under selected chambers 31 in the upper body portion 22.

The lower outer cylindrical surface 46 of the upper body portion 22 is offset inwardly from the cylindrical surface 48 of the upper body portion 22 thereabove, with the extent of the inward offset being equivalent to the thickness of the sleeve 44 of the lower body portion 23 so that the exterior surfaces of the two body portions are generally cylindrically coextensive.

The lower body portion 23 is retained on the upper body portion 22 by the seating of an inwardly projecting annular rib 49 at the upper end of the sleeve 44 of the lower body portion 23 in an annular groove 50 formed in the upper body portion 23 at the upper extent of the lower cylindrical surface 46 of the upper body portion 22, forming a snap-fit connection.

The aforementioned inlet cup 28 is formed integrally with the lower body portion 23 and depends cylindrically therefrom to form a cylindrical interior that is centered at the same radial spacing from the central axis 32 of the device 20 as the aforementioned upper body portion chambers 31. The cylindrical interior 51 of the inlet cup 28 is of the same general annular extent as the upper body portion chambers 31 so that upon rotation of the lower body portion 23 the cylindrical interior 51 of the inlet cup 28 may be selectively aligned with the upper body portion chambers 31, thereby providing a generally continuous cylindrical interior is provided.

The diameter and vertical extent of the cylindrical interior 51 of the inlet cup 28 are sufficient for receipt in the cylindrical interior 51 of a spherical element in the form of a ball 53. The aforementioned insert 29 in the bottom of the inlet cup 28 is formed with a ball seat 54 at its upper end within the cylindrical interior 51. This ball seat 54 is enlarged annularly outwardly for centering of the ball 53 when it rests on the ball seat 54. Preferably, the top of the ball is in general alignment with the bottom surface 36 of the upper body portion 22.

The chambers 31 in the upper body portion 22 selectively contain no, one, two, or a plurality of balls. In the preferred embodiment illustrated, one chamber does not contain any ball so that yarn tension is applied only by the ball 53 in the inlet cup 28. In a second chamber, a single ball 55 is contained so that, when the inlet cup 28 is aligned with this chamber, there will be two balls 53,55 applying tensioning gravitational force to the running yarn. In the third chamber, there are two balls 56,58 so that, when the inlet cup 28 is aligned with this chamber, there will be three balls 53,56,58 applying gravitational pressure to the running yarn. In the embodiment illustrated, the ball 53 in the inlet cup 28 is smaller than the balls 55,56,58 in the chambers 31, but any combination of size and number of balls can be selected to obtain a desired variation in tension in the three chambers 31. Further, the inlet cup 28 can be formed with a sufficiently shallow cylindrical interior 51 so that the ball seat 54 is at generally the same level as the bottom of the chambers 31 and no ball would be positioned in the inlet cup 28 and the balls in the chambers 31 would be varied and selected to provide the desired selective yarn tensioning effect.

While balls are disclosed in the preferred embodiment, other shapes of yarn tensioning elements could be utilized, such as elongated elements having semi-spherical or partially spherical ends. Also, only the ball that is seated on the ball seat 54, which is the ball 53 in the inlet cup 28, needs to have a surface shaped to be compatible with the ball seat 54. The other elements 55,56 may be of any selected shape suitable for positioning on the lower ball 53 as their primary purpose is to add weight to the ball combination.

Also, preferably, the outlet cap 30 is permanently secured in the top of the upper body portion 22 so that the selected ball combination cannot be changed or the balls removed purposely or accidentally once the device has been assembled with the selected ball combinations.

With the device of the preferred embodiment as described, a yarn tensioning device manufacturer or supplier or a textile machine manufacturer or supplier that includes ball tensioning devices can provide a customer with a machine having varying yarn tensioning capabilities with only one yarn tensioning device and need not supply an inventory of balls to the customer for variation of the tensioning by the customer, with the corresponding advantage to the customer of not having to maintain an inventory of different numbers and sizes of balls for changing the ball tension when changing a machine to handle different yarns. In addition, the reliability of the yarn tensioning is not dependent on the reliability of the operator to provide the right ball combination in the yarn tensioning devices when changeovers are being made. In addition, the supplier of the machine does not have to assemble the ball tension devices specially for order, but rather can obtain ball tensioning devices of the present invention from the ball tensioning device manufacturer and need not be concerned about adapting the devices for each particular customer's desired usage.

To properly align and maintain alignment of the inlet cup 28 selectively with the chambers 31 of the upper body portion 22, a bore 59 is formed in the lower body portion 23 and extending parallel to the central axis 32. The upper body portion 22 is formed with three bores 60, each of which is in a position to be aligned with the bore 59 in the inlet cup 28 when the inlet cup is aligned with a respective chamber 31. The bores 59,60 receive a pin 61 that can be inserted into one of the bores 60 that corresponds with a selected chamber alignment and the pin will then extend into the bore 59 in the aligned inlet cup 28. The bottom of the inlet cup bore 59 is tapered and closed so that the pin 61 will not fall through the device, but will remain extending into both portions to lock them together against rotation. The pin 61 can be fitted to be driven into the bores 59,60 so that it cannot be removed. In this way, a supplier or user can lock the device into a desired ball number and size combination and it cannot be accidentally or purposely changed to vary the tensioning effect during use. Alternatively, the pin 61 may be formed with a head or other configuration to allow removal of the pin 61 to allow the inlet cup 28 to be rotated into different insert alignments.

The balls 60 in the upper body portion chambers 31 are retained in their respective chambers and prevented from moving into or through the open axial space 35 by an axially extending post 62 that is secured to the flat surface 43 of the lower body portion 23 in alignment with the central axis 32 and extends upwardly from the surface 43 into the common communication 38.

To prevent yarn from wrapping around the post 62 by rotation of the lower body 23 on the upper body portion 22, rotation limiting components or stops 63,64 are formed on the upper and lower body portions 22,23, respectively. The stop 63 on the upper body portion 22 projects outwardly from the upper surface 48 of the upper body portion 22 and the stop 64 on the lower body portion 23 projects outwardly from the sleeve 44 of the lower body portion 23 adjacent the upper body portion 22 and projects vertically in alignment with the stop 63 of the upper body portion 22. Thus, upon relative rotation of the body portions 22,23, the stops 63,64 will engage to prevent full or multiple rotation of the lower body portion 23 about the upper body portion 22.

To allow cleaning of lint and debris from the cylindrical interior 51 of the inlet cup 28 and from the seat 54 and ball 53 therein, three slots 65 are formed through the sides of the inlet cup 28. These slots 65 extend parallel to the central axis 32 and are equally spaced around the periphery of the inlet cup 28 adjacent the exterior surface of the sleeve 44, which also has three equally spaced cleaning slots 66 which extend throughout the vertical extent of the sleeve 44 parallel with the central axis 32. Similar slots 68 are formed in the upper body portion 22 so that upon alignment of the slots in the sleeve 66 and in the upper body portion 68, air can be blown through the slots into the interior of the chambers 31 to blow out dust and any other debris. The slots 66 in the sleeve extend upwardly through the upper end of the sleeve 44 and, to prevent inadvertent or purposeful spreading of the slotted sleeve 44 that could cause disengagement of the lower body portion 23 from the upper body portion 22, a retaining band 69 may be fastened around the upper area of the sleeve 44 and retained in place by a clamp 70.

Variations can be made in the preferred embodiment illustrated in FIGS. 1–12, such as reversing the chambers 31 to be formed in an upwardly extending lower body portion, with the upper body portion having a depending sleeve in which the lower body portion is seated. Similarly, the number of balls or absence of balls and the size and/or weight of the balls may be varied in the different chambers to suit desired selectable tensioning conditions. Further, the chambers need not be semi-cylindrical in cross-section as various other cross-sections can be used to retain the balls in yarn engagement. Also, while a central axial opening 39 is preferred, the device can be arranged with an offset opening, such as in alignment with the inlet cup 28 and adjustable therewith for alignment with the chamber with which the inlet cup is aligned.

In use, a yarn is threaded upwardly through the insert 29 in the inlet cup 28 and is deflected by the ball 53 in the inlet cup, thereby being subjected to a tensioning force by the ball 53. The yarn then extends through the aligned chamber 31 of the upper body portion 22 and is subjected to whatever balls are in the aligned chamber 31. The yarn then travels through the outlet cap 30 and is supplied with the applied tension to the textile machine with which the device 20 is associated. The balls 53,55,56 in the aligned chambers 31,51 apply tensioning force to the yarn that is substantially uniform regardless of a fluctuating tension in the yarn upstream of the device 20. If there is greater tension in the yarn traveling through the device 20, the tensioned yarn tends to straighten and move the ball sideways on the ball seat 54 so that more of the weight of the ball 53 is supported on the ball seat 54 and is not being applied to the traveling yarn. Thus, the ball or balls apply a tension to the traveling yarn even if there is little or no tension in the yarn arriving at the device and fluctuations in tension are minimized by displacement of the ball 53 in the inlet cup 28 such that substantially uniform tension is in the yarn as it travels from the device to the associated machine for further processing into fabric or for whatever other purpose the machine may be intended to accomplish.

An alternative embodiment of the yarn tensioning device is illustrated in FIGS. 13–18. In this embodiment, the device 80 is formed with an upper body portion 81 that is rectangular in both horizontal and vertical cross-section with a plurality of chambers 82, such as the three illustrated, being arranged in a row, rather than about a central axis as in the embodiment of FIGS. 1–12. These chambers 82 are open at the bottom 83 of the upper body portion 81 and extend upwardly to a narrow elongated outlet 84 that extends above all of the chambers 82. The chambers are cylindrical in shape and the outer two chambers overlap the center chamber to form open spaces 85 therebetween.

An inlet cup 88 similar to inlet cup 28 of the embodiment of FIGS. 1–12 is formed to project from a lower body portion 87, which is mounted to the bottom 83 of the upper body portion 81 for sliding movement to selectively align the cup 88 with the chambers 82. The lower body portion 87 has flat plate-like extensions projecting along the bottom 83 of the upper body portion 81, which extensions 89 extend sufficiently to provide a closure surface for the chambers 82 at which the inlet cup 88 is not aligned, thereby retaining balls in the chambers 82. The plate-like extensions 89 of the lower body portion 87 are slidably received and retained in inturned flanges 90 that depend from the upper body portion 81 along the sides at the bottom thereof, which slidingly retain the lower body portion 87 under the upper body portion 81.

As in the embodiment of FIGS. 1–12, a small ball 91 is disposed in the inlet cup 88, although the cup could be formed flat without a ball in it. The chambers 82 of the body portion 81 contain no, one, and two larger balls 92 for the same purpose as the arrangement of balls 55,56,58 in the embodiment of FIGS. 1–12.

To lock the cup 88 in alignment with a selected upper body portion chamber 82, three apertures or bores 93 are formed in the upper body portion 81 extending therethrough from top to bottom. The bores 93 are offset laterally from the chambers 82 and are longitudinally spaced the same as the spacing between the centers of the chambers 82. A corresponding bore 94 is formed in the lower body portion 87 extending partially therethrough from the top surface thereof. This lower body portion bore 94 is located with respect to the cup 88 and upper body portion bores 93 so that when it is selectively aligned with an upper body portion bore 93 the cup 88 will be aligned with a corresponding upper body portion chamber 82. A pin 95, similar to the pin 61 in the embodiment of FIGS. 1–12, is insertable in the aligned bores 93,94 to lock the body portions 81,87 together with the cup 88 aligned with the upper body portion chamber 82 corresponding to the particular bore alignment.

The operation of this device is the same as in the device of FIGS. 1–12, with straight line movement of the cup 88 rather than rotational movement as in the embodiment of FIGS. 1–12.

Figure 16:
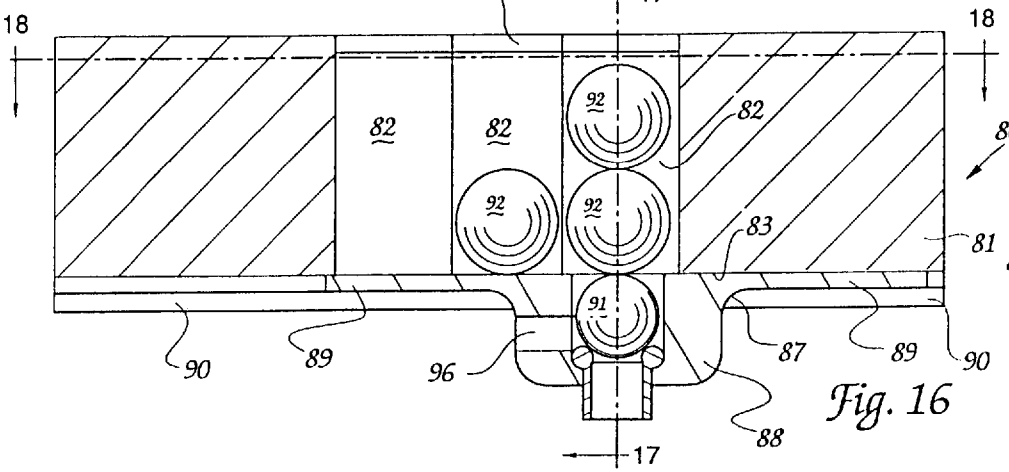
FIG. 16 is a vertical sectional view taken along line 16–16 of FIG. 15 showing the inlet cup in a second position.

As in the embodiment of FIGS. 1–12, the alternate embodiment may be provided with slots opening from the exterior into the chambers to permit cleaning of the chambers by air blown through the slots into the chambers. For example, a cleaning slot 96 is shown in FIG. 16 in the side of the inlet cup 88 opening into the interior of the cup. Similar slots (not illustrated) may be provided in the upper body portion 81 and opening into the upper body portion chambers 82.

While the devices of both embodiments are intended for operation with the yarn running upwardly therethrough, if circumstances dictate, the yarn can be run downwardly through the device, the balls applying a similar application of tension to the yarn. Also, in some applications, the device may be tilted rather then being vertical as illustrated.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. An adjustable yarn tensioning device for maintaining generally uniform tension in a running textile yarn, comprising:

a housing having an upper body portion and a lower body portion connected to said upper body portion for relative movement with respect thereto;

one of said body portions having a plurality of chambers, each of said chambers having an interior opening at the other of said body portions and a communication with the exterior at a spacing from said interior opening;

the other of said body portions having a chamber having an inner opening at said one body portion and a communication with the exterior at a spacing from said inner opening, said other body portion chamber being selectively positionable in alignment with the chambers in said one body portion upon relative movement of said body portions, said other body portion having a closure surface covering all of said body portion interior openings at which the other body portion chamber is not aligned;

a plurality of at least partially spherical elements disposed in said chambers, with the characteristics of said elements differing in each of said chambers;

said lower body portion has a seat in said exterior communication for support of a spherical one of said elements, with the seat having a yarn passage therethrough and said lower body portion adjacent said seat being shaped to retain the spherical portion of the element in contact with a yarn running through said passage.

2. An adjustable yarn tensioning device according to claim 1, characterized further in that the number of said at least partially spherical elements is different in each of said chambers to provide said differing characteristics.

3. An adjustable yarn tensioning device according to claim 1, characterized further in that the size of said at least partially spherical elements is different in each of said chambers to provide said differing characteristics.

4. An adjustable yarn tensioning device according to claim 1, characterized further in that the number and size of said at least partially spherical elements is different in each of said chambers to provide said differing characteristics.

5. An adjustable yarn tensioning device according to claim 1, characterized further in that said elements are spherical.

6. An adjustable yarn tensioning device according to claim 1, characterized further in that said one body portion is said upper body portion and said other body portion is said lower body portion.

7. An adjustable yarn tensioning device according to claim 6, characterized further in that said chamber in said lower body portion is cylindrical.

8. An adjustable yarn tensioning device according to claim 7, characterized further in that said upper body portion chambers are at least partially cylindrical adjacent said openings thereof.

9. An adjustable yarn tensioning device according to claim 8, characterized further in that said upper body portion chambers extend parallel to each other to a common communication with the exterior.

10. An adjustable yarn tensioning device according to claim 9, characterized further in that said upper body portion chambers are spaced equidistant about a central axis.

11. An adjustable yarn tensioning device according to claim 10, characterized further by an annular outlet cap seated in said common communication, and said cap and said common communication have complementary tapered inner surfaces.

12. An adjustable yarn tensioning device according to claim 10, characterized further in that said upper body portion chambers are open toward said central axis to form a common central axial space, and further characterized by a post extending in said space along said central axis to retain said elements in their respective chambers.

13. An adjustable yarn tensioning device according to claim 12, characterized further in that said upper body portion chambers are semi-cylindrical outwardly of said common central axial space.

14. An adjustable yarn tensioning device according to claim 12, characterized further in that said common communication is centered on said central axis.

15. An adjustable yarn tensioning device according to claim 14, characterized further by an annular outlet cap seated in said common communication, and said cap and said common communication have complementary tapered inner surfaces.

16. An adjustable yarn tensioning device according to claim 10, characterized further in that said upper and lower body portions are rotatable relative to each other about said common central axis.

17. An adjustable yarn tensioning device according to claim 16, characterized further in that said upper body portion has a relatively flat lower end extending transverse to said central axis and containing said openings therein, and said closure surface of said lower body portion is relatively flat and extends transverse to said central axis opposite said lower end of said upper body portion.

18. An adjustable yarn tensioning device according to claim 17, characterized further in that said upper body portion has an exterior cylindrical surface extending upwardly from said lower end and centered on said central axis, and said lower body portion has a cylindrical sleeve centered on said central axis and extending upwardly along said cylindrical surface of said upper body portion and relatively rotatable thereabout.

19. An adjustable yarn tensioning device according to claim 18, characterized further in that one of said cylindrical surface and cylindrical sleeve has an annular groove facing the other and the other has an annular rib engageable in said groove to retain said body portions in assembled rotatable relation.

20. An adjustable yarn tensioning device according to claim 18 and characterized further in that said lower body portion cylindrical sleeve and said upper body portion are formed with alignable slots extending therethrough from the exterior to the chambers to permit cleaning of lint and other matter from the chambers upon blowing air through the slots.

21. An adjustable yarn tensioning device according to claim 16, characterized further by complementary projections formed on said upper and lower body portions engageable to limit relative rotation of said body portions to less than one full revolution.

22. An adjustable yarn tensioning device according to claim 8 and characterized further in that said housing is formed with slots extending therethrough from the exterior to the chambers to permit cleaning of lint and other matter from the chambers upon blowing air through said slots.

23. An adjustable yarn tensioning device according to claim 22 and characterized further in that said slots extend substantially the full cylindrical extent of said chambers.

24. An adjustable yarn tensioning device according to claim 1 and characterized further in that said housing is formed with slots extending therethrough from the exterior to the chambers to permit cleaning of lint and other matter from the chambers upon blowing air through said slots.

25. An adjustable yarn tensioning device according to claim 1, characterized further in that said upper and lower body portions have complementary alignable formations disposed for alignment upon each chamber alignment, and a component engageable with said formations when aligned to maintain said body portions in a selected chamber alignment and disengageable to permit relative movement of said upper and lower body portions.

26. An adjustable yarn tensioning device according to claim 25, characterized further in that said formations are apertures and said component is a pin engageable in aligned apertures to retain the chambers in alignment and disengageable from at least one aperture to permit relative movement of said upper and lower body portions.

* * * * *

UNITED STATES PATENT AND TRADEMARK OFFICE

CERTIFICATE OF CORRECTION

PATENT NO. : 5,820,050

DATED : October 13, 1998

INVENTOR(S) : Zollinger

It is certified that error appears in the above-identified patent and that said Letters Patent is hereby corrected as shown below:

Col. 3, line 30, delete "taking" and insert --taken-- therefor.
Col. 5, line 6, delete "is provided".
Col. 8, line 29, delete "then" and insert --than-- therefor.
Col. 9, line 8, delete "a spherical".

Signed and Sealed this

Eighth Day of June, 1999

*Attest:*

Q. TODD DICKINSON

*Attesting Officer*

*Acting Commissioner of Patents and Trademarks*